United States Patent [19]

Keller

[11] Patent Number: 4,815,667

[45] Date of Patent: Mar. 28, 1989

[54] SYSTEM AND METHOD FOR RECOVERY OF SALVAGEABLE FERROUS AND NON-FERROUS METAL COMPONENTS FROM INCINERATED WASTE MATERIALS, AND A SELECTIVE CRUSHER THEREFOR

[75] Inventor: Samuel Keller, Cuyahoga Falls, Ohio

[73] Assignee: Shaneway, Inc., Akron, Ohio

[21] Appl. No.: 116,399

[22] Filed: Nov. 3, 1987

Related U.S. Application Data

[63] Continuation-in-part of Ser. No. 790,818, Oct. 24, 1985, abandoned.

[51] Int. Cl.[4] ..... B02C 21/00

[52] U.S. Cl. ..... 241/14; 241/24; 241/76; 241/79.1; 241/81; 241/142; 241/198 A; 241/240; 241/289; 241/DIG. 38

[58] Field of Search ..... 241/14, 198 A, 24, DIG. 38, 241/81, 239, 79.1, 240, 79, 241, 288, 101.2, 289, 287, 264, 76, 77, 290, 78, 135, 142, 286, 138, 154, 224

[56] References Cited

U.S. PATENT DOCUMENTS

| | | | |
|---|---|---|---|
| 1,357,015 | 10/1920 | Whitney | 241/142 X |
| 1,783,373 | 12/1930 | Borton | 241/198 A |
| 3,086,718 | 4/1963 | Lukas | 241/24 |
| 4,044,956 | 8/1977 | Benedetto et al. | 241/24 |
| 4,288,039 | 9/1981 | Waskow | 241/198 A |
| 4,406,412 | 9/1983 | Alexandersson | 241/37 X |

FOREIGN PATENT DOCUMENTS

| | | | |
|---|---|---|---|
| 552801 | 5/1923 | France | 241/198 A |
| 1572591 | 7/1980 | United Kingdom | 241/198 A |

*Primary Examiner*—Mark Rosenbaum
*Attorney, Agent, or Firm*—Reed Smith Shaw & McClay

[57] ABSTRACT

The present invention pertains to a system and a method for recovering salvageable ferrous and non-ferrous materials from incinerated waste materials including friable, carbonaceous incineration byproducts such as ash and associated ferrous and non-ferrous metal components. The system includes at least one crushing means for selectively comminuting friable material comprised of a rotating roll having at least one protrusion, preferably a weld extending transversely to the direction of rotation of roll, on its exterior cylindrical surfaces in spaced relation to a backing plate. The backing plate is urged toward the roll by a bias means exerted a preferably adjustable pressure sufficient to comminute the friable carbonaceous material to a desired size, and insufficient so as to permit the backing plate to retract and allow passage of ferrous and non-ferrous components in the waste material through the crushing means substantially uncomminuted. The bias means tends to rapidly urge the retracted backing plate to its set position and exert a selective comminution pressure through the retraction cycle. At last a first separating means coacts with the first crushing means for at least partially separating comminuted carbonaceous incineration byproducts from ferrous and non-ferrous metal components; and first magnetic means separates ferrous metal components from the waste material. The present invention further relates to a novel crusher for selectively comminuting friable materials without substantially comminuting associated malleable materials.

26 Claims, 6 Drawing Sheets

SYSTEM AND METHOD FOR RECOVERY OF SALVAGEABLE FERROUS AND NON-FERROUS METAL COMPONENTS FROM INCINERATED WASTE MATERIALS, AND A SELECTIVE CRUSHER THEREFOR

RELATED APPLICATION

This application is a continuation-in-part of copending, and subsequently abandoned, application Ser. No. 06/790,818, filed Oct. 24, 1985.

FIELD OF THE INVENTION

The present invention relates in general to a system and method for recovery of salvageable materials from refuse, and specifically to a system and method for the efficient and economical recovery of ferrous and non-ferrous metal components from incinerated waste materials. The present invention further relates to a selective crusher suitable for use in the system and method.

BACKGROUND OF THE INVENTION

Recovery of Salvageable Metal:

In recent years, there has been a dramatic increase in the volume and variety of solid waste products requiring disposal by both the private and public sectors. Such solid waste products have in the past been burned in open incinerators. However, due to current environmental laws and regulations, open incineration of solid waste has been restricted to a significant extent in many geographic areas and in fact is prohibited in many urban areas today.

Disposal and burial of solid waste products in sanitary landfills is a frequently used alternative disposal method. However, many existing landfills are reaching their capacity and additional replacement clean landfills have not been approved by regulatory agencies and authorities due to existing environmental laws and regulations and due to an actual shortage of land in some geographic areas.

Recovery of salvageable and recyclable metals, of course, reduces the maount of waste products that must be disposed. Apparatus and methods for recovery of salvageable and recyclable components, such as glass, plastics, non-ferrous and ferrous materials, from solid waste products are known in the prior art, e.g., U.S. Pat. Nos. 3,086,718; 3,549,092; 3,659,396; 3,687,062; 3,788,568; 3,790,091; 3,885,744; 3,973,736; 4,020,992; 4,044,956; 4,070,278; 4,083,774; 4,337,900; 4,341,353; 4,362,276; and 4,387,019. Such recovery apparatus and methods proposed recovery of ferrous and non-ferrous metal components from solid waste products both prior to and subsequent to incineration of the solid waste products. However, ferrous and non-ferrous metal components are generally not efficiently or economically recovered by such prior art apparatus and methods.

Particularly, the systems and means for recovering non-ferrous materials that have been proposed to date for separation of non-ferrous metal from incinerated solid waste and ferrous waste components are expensive to build, expensive to operate and resulted in low percentage of recovery of non-ferrous metals. It has been proposed to indiscriminately comminute the non-ferrous metals, along with the ferrous metals and other materials in the incinerated solid waste, and then separate the non-ferrous metal by a float-sink method. Alternatively, it has been proposed to comminute the incinerated solid waste in a cage mill and then separate the non-ferrous metal in a two-stage trommel screen. These methods have been discontinued, however, because of the low efficiency in recovery of non-ferrous metals and the high costs of assembly and operation of the equipment and system.

In addition, the quality of the recovered ferrous and non-ferrous products varies widely due to the incinerated waste product carryover (called "tramp"), and the extreme variability of the moisture content (typically 20 to 75%) in both the pre-incinerated and incinerated waste material.

A need thus exists for a system that will permit efficient and economic recovery of ferrous metal, such as iron and steel, and non-ferrous metal, such as aluminum, from incinerated waste materials including friable carbonaceous incineration byproducts, such as ash. Such a system, should not only permit the recovery of the salvageable ferrous and non-ferrous metal components with relatively low percentage of tramp, but also should reduce the amount of the incineration byproduct, e.g., ash and metal, that must be disposed by conventional disposal such as landfill. As to the latter, the present system allows for reclaim of carbonaceous incineration byproducts for use as ballast for road beds and the like, in addition to efficient and economical recovery of ferrous and nonferrous metals.

Crusher Devices:

Various types of devices for crushing and communication have been known for decades. These include hammermills, cage mills, attritors, ball mills and rod mills. These devices have been used to crush and comminute a whole myraid of materials from rock, coal, ores and solid waste to chocolate and paint pigment.

U.S. Pat. No. 2,582,734 discloses one such crusher which has relation as prior art to the presently claimed subject matter. A horizontal roll crusher is disclosed that has a main eccentric gyrated crusher drum positioned between the crushing plate surfaces of a pair of swing jaws. Each swing jaw is supported and resiliently carried by springs and hydraulic shock absorbers. These bias means are designed primarily to provide the function of protecting the swing jaws and the other parts of the crusher against excessive mechanical overload, as well as secondarily to serve the additional function of accurately positioning the swing jaws in accordance with the relative wear of crusher surfaces and in accordance with the desired finest of the crushed product to be produced by the crusher.

Another example of a similar prior art crusher is disclosed in U.S. Pat. No. 1,783,373. A single-roll crusher is disclosed that has a breaker-plate mounted to crush coal, ore and the like in the throat between the breaker plate and the single roll. The improvement there described is a breaker plate in a plurality of sections hanging from a single shaft, each section of which is independently supported and postioned in alignment with the crusher roll. The breaker-plate is urged toward the crusher roll by bias means that permit relief to avoid breakage and cracking when foreign objects, such as large pieces of wood, tramp iron and the like, are delivered to the crusher along with the coal, ore or other material to be crushed. The purpose of the bias means is to avoid breaking or cracking of the backer-plate or crusher roll by "a large foreign body, incapable of being crushed," thereby avoiding the condition that would require stoppage of the crusher and dismantling the machine until a new backer-plate or roll could be supplied.

In these prior art crushers, the bias means avoided damage to the machine upon the encounter of the rare, foreign body that was incapable of being crushed. There is no suggestion that the bias means exert such pressure so as to selectively comminute certain materials within a mix of materials while allowing associated materials to remain substantially uncomminuted. To the contrary, the pressure exerted by the bias means is purposely set very high so as to indiscriminately comminute all of the materials encountered except for those few pieces incapable of being crushed, where breaking or cracking the machine would result. Also, there is no suggestion in these prior art crushers of regulating the pressure exerted by the bias means to allow efficient comminution of select materials within a mix while avoiding comminution, to the extent possible, of associated materials within the material fed to the crusher.

STATEMENT OF THE INVENTION

The present invention pertains to a system for recovering salvageable ferrous and non-ferrous metals from incinerated waste materials, including friable carbonaceous incineration byproducts such as ash and associated ferrous and non-ferrous metal components. The invention comprises first conveying means for conveying incinerated waste material to a first selective crushing means; first selective crushing means for substantially comminuting carbonaceous incineration byproducts while avoiding substantial comminution to associated ferrous and non-ferrous metal components; first separating means coacting with said first crushing means for separating at least in part comminuted carbonaceous incineration byproducts from the waste material; first magnetic means for separating at least in part ferrous metal components from non-ferrous metal components in the selectively comminuted waste material; and collection stations for collecting separated comminuted carbonaceous incineration byproducts, separated ferrous components and remaining waste material containing non-ferrous components.

The first selective crushing means is comprised of a rotatably mounted roll and a backing plate positioned in juxtaposition to the roll to form a throat through which material to be comminuted may pass. The throat is shaped such that the backing plate exerts concentrated pressure on waste material on passage thereof through the throat between the backing plate and the roll. The rotating roll has at least one protrusion, preferably a weld, on the exterior cylindrical surfaces thereof facilitating passage of waste material, or other similar material to be comminuted, through the throat. The backing plate is urged toward the roll by a bias means exerting a pressure sufficient to comminute carbonaceous incinerated products in the waste material in the throat, and insufficient so as to permit the backing plate to retract and allow passage of associated ferrous and non-ferrous metal components in the waste material through the crushing means substantially uncomminuted. In this regard, some comminution of the ferrous and non-ferrous metal components may be tolerated to permit efficient comminution of carbonaceous byproducts. For this reason, preferably the bias means is capable of regulating the pressure exerted on the waste material and is capable of maintaining the pressure during retraction of the backing plate.

Additionally, the first separating means is preferably comprised of a means for orienting comminuted material discharged from the first crushing means so as to tend to present flat and elongated surfaces to the separating means in such way that elongated and flat metallic material tends to be retained by the separating means, thereby enhancing the separation of carbonaceous components from the ferrous and non-ferrous metal components.

In a more preferred embodiment, the system further comprises second selective crushing means for further selectively comminuting carbonaceous incineration byproducts while avoiding substantial comminution of associated ferrous and non-ferrous metal components; and second separating means coacting with the second crushing means for selectively separating at least in part additional comminuted carbonaceous incineration byproducts from ferrous and non-ferrous metal components. In addition, second conveying means are preferably provided for conveying waste material with ferrous and non-ferrous metal components to the second crushing means, and a third conveying means for conveying the separated solid waste containing ferrous and non-ferrous metal components from the second separating means to the first magnetic means.

In an even more preferred embodiment, the system further comprises, prior to said first selective crushing means, a preliminary magnetic means for separating ferrous metal components from the incinerated waste material and a preliminary separating means for separating non-carbonaceous materials other than ferrous and non-ferrous metal components, such as glass, sand and dirt, from the incinerated waste materials. By these preliminary means, the quantity of carbonaceous byproducts and ferrous metal components in the waste material can be reduced to allow for more efficient recovery of the ferrous and non-ferrous metal components in the system.

The present invention further relates to a method for recovery of ferrous and non-ferrous metal components from incinerated waste materials using the system of the present invention; and to a novel selective crusher, as described generally above, for selectively comminuting friable carbonaceous materials while avoiding substantial comminution of associated malleable materials. The selective crusher is suitable for applications other than the recovery system and method of the present invention.

Other details, objects and advantages of the invention will become apparent as the following description of the presently preferred embodiments and presently preferred methods of practicing the invention proceeds.

BRIEF DESCRIPTION OF THE DRAWINGS

In the accompanying drawings, the preferred embodiments of the invention and preferred methods of practicing the invention are illustrated in which.

DETAILED DESCRIPTION OF THE INVENTION

The present invention is directed to a system for recovering salvageable ferrous and non-ferrous materials from incinerated waste materials including friable carbonaceous incineration byproducts such as ash, and associated ferrous and non-ferrous metal components. The invention is comprised of a first conveying means for conveying incinerated waste materials to a first selective crushing means; first selective crushing means for selectively comminuting carbonaceous incineration byproducts without comminuting, to the extent possible, associated ferrous and non-ferrous metal components; first separating means coacting with said first crushing means for separating at least in part comminuted carbonaceous incineration byproducts from the ferrous and non-ferrous metal components; and first magnetic means for separating at least in part ferrous metal components from the selectively comminuted waste material; and collection stations for collecting separated comminuted carbonaceous incineration byproducts, ferrous metal components, and remaining waste material including non-ferrous metal components. The first magentic means preferably removes ferrous components from the waste material after selective comminution and after separation of carbonaceous byproducts for efficient operation.

The feed material processed in the recovery system generally consists of the bottoms remaining after incineration of waste materials, and preferably the bottoms produced in a mass or shredded burning operation used to generate electricity from municipal waste. The bottoms product generally includes incinerated carbonaceous byproducts, such as ash, and associated ferrous metals components, such as iron and steel, and non-ferrous metal components, such as aluminum, copper, nickel, silver, gold and brass. The bottoms product may also, include glass, ceramics and other refuse, typically contained in municipal refuse, that are not completely incinerated at the temperatures attained in the furnace. Although incinerated waste materials are the preferred feed stock of the invention, other feed materials including ash and ash-related products with non-ferrous and/or ferrous metal components are also suitable.

Figure 1:
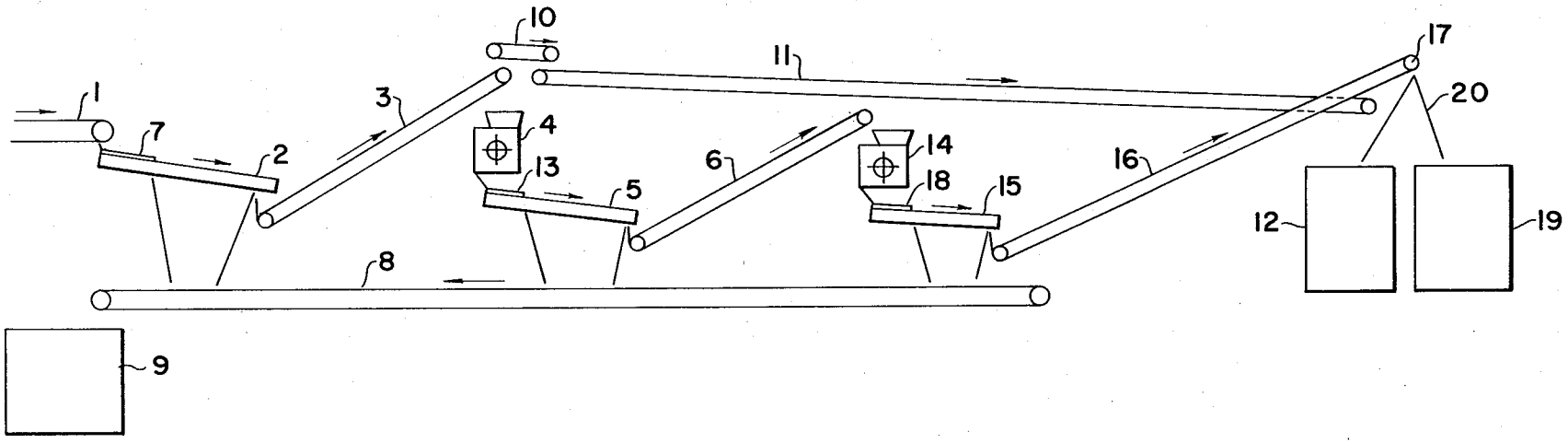
FIG. 1 is a process schematic diagram of a preferred embodiment of the recovery system of the present invention.

Referring to FIG. 1, the feed material is delivered to first selective crushing means 4 in the recovery system of the invention preferably by a first conveying means 3. First conveying means 3 may be a belt-type conveyor at an angle from the horizontal. The system includes a first separating means 5 receiving the selectively comminuted feed material from first crushing means 4. Second conveying means 6, typically a belt-type conveyor or another conventional conveyor similar to first conveying means 3, may also be provided for conveying the remaining feed material from the first separating means 5.

Preferably the feed material, conveyed from an incineration plant by conveying means 1, is also preliminarily processed before delivery to first conveying means 3 by a preliminary separating means 2 to remove a large amount of the carbonaceous ash component, such as glass, said and dirt, and improve processing efficiency in the recovery system. Also, preferably components greater than about four to ten inches in size are removed by a grissly or trommel before the waste material reaches the end of conveying means 1. Separating means 2 is preferably at a variable angle vibrating conveyor/screen separator in order to regulate the variable flow of the waste material across the screen/conveyor to enhance separation. The screen angle is preferably between about 10 and 45 degrees from the horizontal, and most preferably between 13 and 20 degrees, with the exact angle being selected to maximixe the retention time of the material on the screen without overloading the screen, and still maintaining operating efficiency to the system. In addition, separating means 2 may be comprised of a substantially flat, preferably solid plate 7, preferably about 2 to 3 feet in length and fastened to the separator means, onto which the waste material is discharged from conveying means 1 so that pieces in the waste material tend to be oriented to present flat and elongated surfaces to the separating means in such way that elongated and flat metallic material tends to be retained by the separating means, thereby enhancing separation of the carbonaceous components from the waste material by separating means 2. However, solid plate 7 is not preferred on the preliminary separating means where high quantities of waste material are to be processed at this point in the system. Typically separating means 2 are a vibrating conveyor, and generally remove one-third or more of the incinerated waste material so as to reduce the quantity of feed material processed through the system and in turn increase the efficiency of separation of ferrous and non-ferrous materials from the carbonaceous material during later stages of the system. The separated carbonaceous materials deposited from separating means 2 on carbonaceous-removal conveyor means 8, typically a flat belt conveyor, are conveyed to a sized-ash collection station 9, for use, or returned to the incineration plant.

Also, a preliminary magnetic means 10 is preferably provided adjacent first conveying means 3 for removal of large ferrous pieces, such as iron and steel, from the waste material to reduce the quantity of feed material delivered to first crushing means 4 and the other parts of the recovery system, thereyb increasing the system's efficiency. In a preferred embodiment of the invention, magnetic means 10 is a transfer type magnetic head such as manufactured by Sterns Magnetics, Inc. or Erie Magnetic, Inc. The ferrous material collected by preliminary magnetic means 10 is deposited on ferrous-removal conveying means 11, typically a belt conveyor, from where it is conveyed to a ferrous collection station 12. Ferrous collection station 12 may be the same as that used for collection of ferrous components later in the system, as shown in FIG. 1, or it may be a separate collection station if desired.

Figure 2:
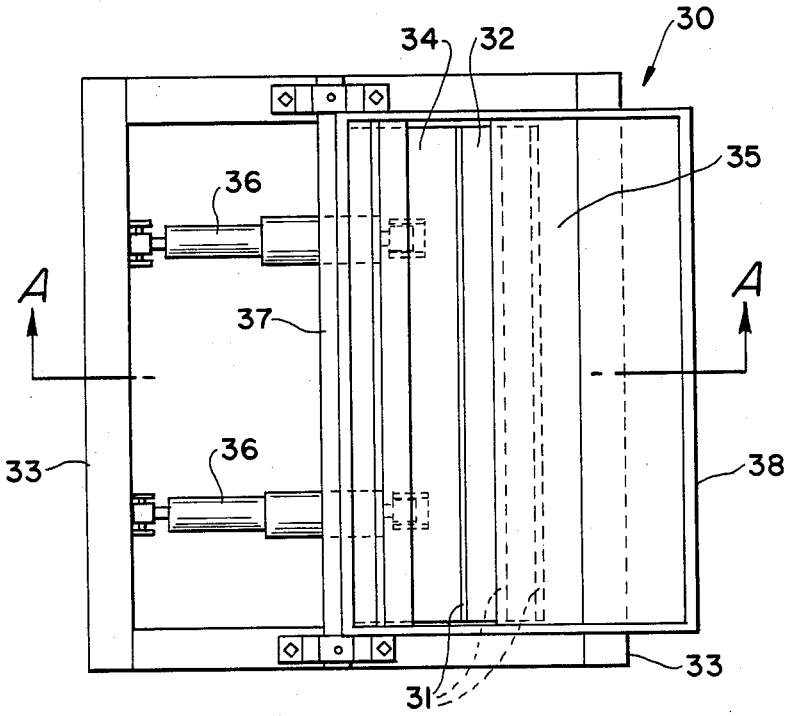
FIG. 2 is a plan view of an embodiment of a preferred selective crusher employed in the present invention.
Figure 3:
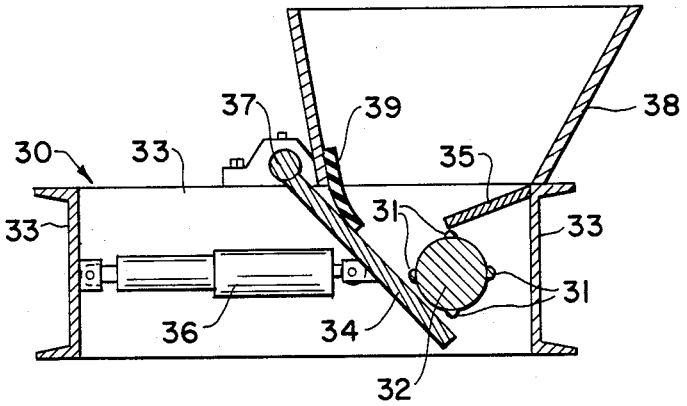
FIG. 3 is a cross-sectional view taken through line A—A of the preferred selective crusher described in FIG. 2.

First selective crushing means 4 is a novel crusher which selectively comminutes friable carbonaceous incineration byproducts to a desired particle size while avoiding, to the extent possible, substantial comminution of associated ferrous or non-ferrous metal components. Crushing means 4 is preferably a roll crusher 30, as shown in FIGS. 2 and 3, comprised of a roll 32, rotatably mounted on frame 33 by conventional bearing means, and a backing plate 34 in juxtaposition forming a throat with roll 32 through which incinerated waste material to be selectively comminuted may pass. Roll 32 also has at least one protrusion 31 that facilitates passage of the waste material through the throat between roll 32 and backing plate 34. Protrusions 31 may be made of any suitable material such as bolts or rivets, but they are preferably metal welds extending across the exterior cylindrical surface of roll 32 transverse to the direction of rotation of the roll. Protrusions 31 in the form of welds are easily formed and replaced with breakage and wear. Protrusion 31 may extend across the entire cylindrical surface of roll 32, or be in staggered on nonstaggered segments. In addition, the welds forming protrusion 31 are preferably hard-faced welds made by welding metal strips to the rolls and then hard facing using suitable welding rods. In any event, the welds preferably provide straight edges perpendicular to the direction of rotation of the roll for more efficient passage of the waste material through crusher 30.

The size of protrusions 31 is preferably less than $\frac{5}{8}$ inch in height to avoid wear, and preferably about $\frac{1}{8}$ to $\frac{1}{4}$ inch in height for efficiency of operation. Also, although one protrusion 31 may be sufficient to provide for operation of crusher 30, preferably at least two to six, and preferably two to four protrusions 31 are provided transversely along the exterior cylindrical surface of roll 32 for efficient operation of crusher 30. The number and spacing of protrusions 31 will vary depending upon the desired efficiency of operation of crusher 30 upon the diameter of roll 32 and the composition of the waste material being processed. The diameter of roll 32 may also vary depending upon the size of the pieces to be comminuted and other design parameters: for comminution of coarser material anticipated in common incinerated waste material, roll 32 may be 10 to 12 inches in diameter, although a smaller diameter, e.g., $4\frac{1}{2}$ inches, is acceptable; and for comminution of smaller particles of incinerated waste materials, smaller diameter roll 32, e.g., $4\frac{1}{2}$ inches, is more preferred.

Backing plate 34 is preferably substantially flat to exert concentrated pressure on the waste material between the backing plate and roll, and in turn provides more efficient selective comminution of the carbonaceous material by crusher 30. The angle formed at the throat between roll 32 and backing plate 34 is not particularly critical. It should be sufficient so as to provide for efficient operation of the crusher, and will depend to some degree upon the diameter of roll 32. The angle selected involves a balancing of the efficiency of processing with the efficiency of separation.

The spacing between roll 32 (at protrusions 31) and backing plate 34 in the throat is preferably slightly less than the desired maximum size of the comminuted carbonaceous byproducts. For example, the spacing would be about $\frac{1}{2}$ inch for comminution of carbonaceous material to about $\frac{3}{4}$ inch in size, and about $\frac{1}{8}$ to $\frac{3}{8}$ inch for comminution of carbonaceous material to about $\frac{1}{2}$ inch in size. The spacing between roll 32 and backing plate 34 is generally between about $\frac{1}{8}$ and $1\frac{1}{2}$ inches and preferably less than 1 inch and more preferably less than about $\frac{1}{2}$ to $\frac{1}{4}$ inch for efficient selective comminution of incinerated solid waste material. The precise spacing for best results will depend upon the particular dimensions of the crusher and the desired capacity of the system.

The incinerated waste materials are conveyed to selective crusher 30 by an inclined plate 35 forming a chute as part of frame 33, from where the material is delivered to the throat between rotating roll 32 and backing plate 34. Chute 38 is also fastened on frame 33 to provide for the feed of waste material, with flexible flap 39 of reinforced rubber or the like contacting backing plate 34 to facilitate flow of waste material to the crusher. Roll 32 is preferably driven with a low power electric motor, e.g., 5 to 25 pH., through a standard pulley and V-belt drive train at relatively low rpm, e.g., 530 rpm and below.

Backing plate 34 is preferably pivotally attached on frame 33 by bearing means 37, as shown in FIGS. 2 and 3. Backing plate 34 is maintained in position by bias means 36, preferably air pressure cylinders, gas hydraulic cylinders or air bags, which are preferably pivotally mounted to frame 33 and to backing plate 34, as shown in FIG. 3. Bias means 36 compresses when larger pieces of ferrous or non-ferrous metal in the incinerated waste materials enter the throat between rotating roll 32 and backing plate 34, and returns rapidly upon passage of the metal component to comminute carbonaceous byproducts in the waste material in the throat between roll 32 and backing plate 34. Bias means 36 is set to exert a pressure sufficient to comminute the carbonaceous incineration byproducts in the waste material, and insufficient so as to permit backing plate 34 to retract and allow passage through the crusher of the associated ferrous and non-ferrous metal components substantially uncomminuted. Bias means 36 also preferably exerts such pressure against backing plate 34 throughout its stroke from set position to maximum release position to maintain the pressure for selective comminution. In a most preferred embodiment, backing plate 34 is maintained in position by two controlled, spaced-apart air or gas pressure cylinders comprising bias means 36 pivotally attached to the base of backing plate 34. For commonly encountered incinerated waste material, bias means 36 are maintained under an air or gas pressure of preferably $40\pm10$ psi and capable of returning to position almost instantly when a piece of ferrous or non-ferrous metallic component passes the throat between rotating roll 32 and backing plate 34. The pressure exerted by bias means 36 is also adjustable to accommodate for variability of hardness of the carbonaceous incineration byproducts encountered in the same incineration processes from time to time, and from different incineration processes. It should be observed in this connection that some comminution of ferrous and non-ferrous metal components will occur in the crusher, and more comminution of ferrous and non-ferrous metal components may need to be tolerated where particularly hard carbonaceous material is to be selectively comminuted. The pressure on bias means can be adjusted to balance between efficient comminution of the carbonaceous byproducts and avoidance of comminution of the ferrous and non-ferrous components.

Figure 4:
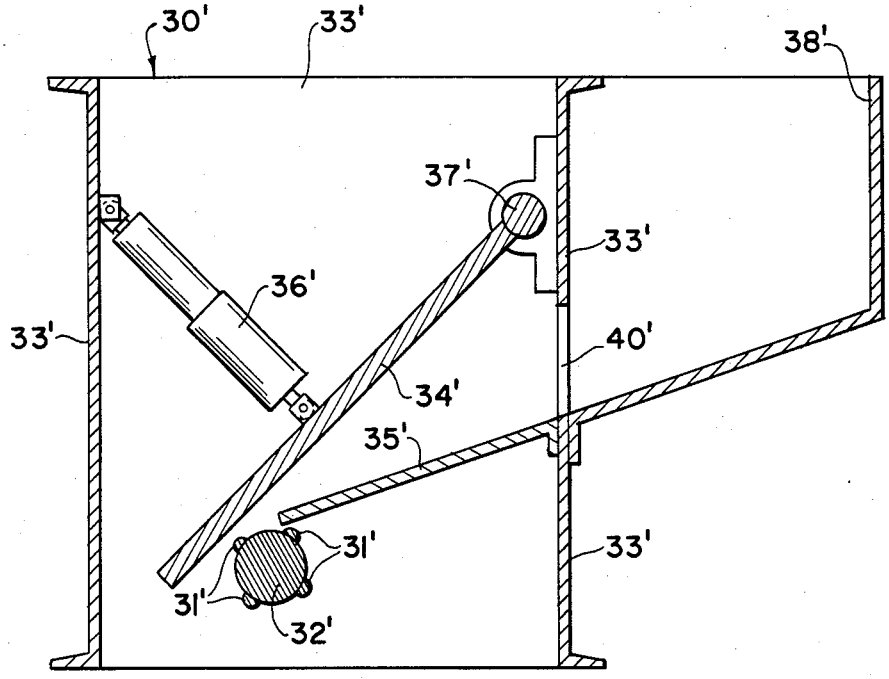
FIG. 4 is a cross-sectional view taken along the line A—A of an alternative preferred selective crusher of the present invention.

Alternatively, selective crushing means 4 may be provided as shown in FIG. 4. That is, selective crusher 30' may be provided with roll 32' rotatably mounted on frame 33' by conventional bearing means, with backing plate 34' pivotally mounted in spaced relation with the roll to form a throat therebetween through which waste material to be selectively comminuted may pass. Roll 32' is again suitably powered by a conventional low power electric motor and V-belt and pulley drive train, and roll 32' again has protrusions 31' as described above facilitating passage of the waste material through the throat. Backing plate 34' is preferably pivotally mounted by bearing means 37' and spaced from roll 32' as described above. Also, as described above, backing plate 34' is maintained in place by air pressure cylinders, gas hydraulic cylinders, air bags or other suitable bias means 36' that are pivotally attached to frame 33' and to backing plate 34'. Bias means 36', through backing plate 34', exerts a pressure on the waste material in the throat sufficient to comminute carbonaceous incinerated products in the waste material to a desired size and insufficient so as to permit backing plate 34' to retract and allow passage of the ferrous and non-ferrous metal components substantially uncomminuted. The waste incinerated waste material is delivered to crusher 30' from chute 38' through opening 40' in frame 33' and by inclined plate 35' forming a chute as part of frame 33'. The alternative selective crusher 30' illustrated in FIG. 4 is not the most preferred mode contemplated for the selective crusher because it does not take maximum advantage of gravity feed into the crusher.

Figure 5:
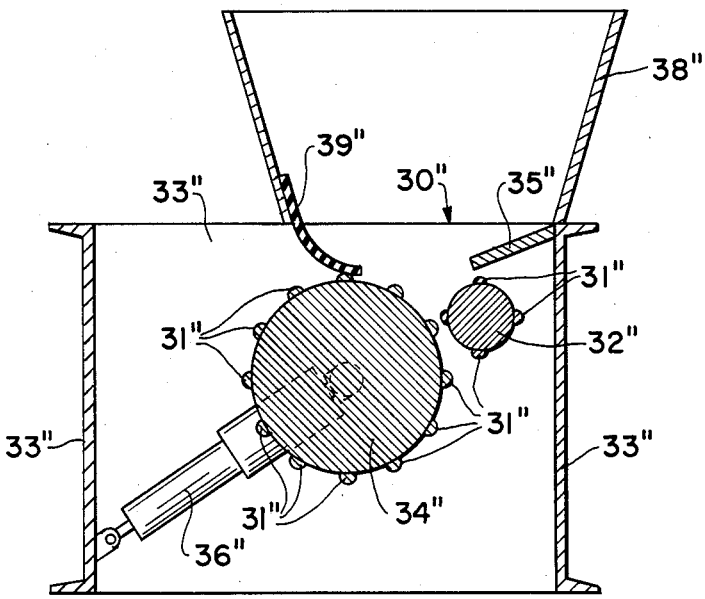
FIG. 5 is a cross-sectional view taken along line A—A of another alternative preferred selective crusher of the present invention.

Still another alternative embodiment of the selective crushing means is illustrated in FIG. 5. Crusher 30" is comprised of roll 32" rotatably mounted by conventional bearing means on frame 33' and has protrusions 31" as described above on the cylindrical exterior surfaces to facilitate passage of the waste material to be selectively comminuted through the crusher. Again roll 32" is preferably powered by a conventional low power electric motor and V-belt and pulley drive train. Backing plate 34" in this embodiment is also a roll in spaced relation from roll 32" forming a throat therebetween through which the waste material to be selectively comminuted may pass. Backing plate 34" in this embodiment is preferably a roll substantially larger than roll 32", as illustrated in FIG. 5. Backing plate 34" in this embodiment also preferably has protrusions 31" facilitating passage of the waste material, preferably spaced so as to correspond with protrusions 31" on roll 32" to provide a concentrated force on the waste material passing through the crusher. Backing plate 34" is preferably rotatably mounted by supporting its pivot axis in a bushing, and maintained in place relative to roll 32" by air pressure cylinders, gas hydraulic cylinders, air bags or other suitable bias means 36", as described above, that are pivotally attached to frame 33" and to backing plate 34". By providing the appropriate pressure on bias means 36", backing plate 34" thus retracts to permit passage of salvageable ferrous and non-ferrous metal materials from the waste material relatively uncomminuted while selectively comminuting carbonaceous incinerated products in the waste material to a desired size in the throat. As in other embodiments, the waste material is delivered to crusher 30" by an inclined plate 35" forming a chute as part of frame 33", and chute 38" supported on frame 33". Here, flexible flap 39" is provided to contact backing plate 34" to facilitate flow of waste material into the crusher.

Referring again to FIG. 1, first separating means 5, which separates carbonaceous incineration byproducts from the comminuted waste material, may be a conventional separator such as a screen separator. Preferably, first separating means 5 is a combination vibrating screen/conveyor such as sold by Bonded Scale and Machine Co. Moreover, first separating means 5 is preferably comprised of a substantially flat, preferably solid plate 13, preferably two or three feet in length and fixed to the separating means, onto which the comminuted waste material is discharged from crushing means 4. Solid plate 13 tends to orient the present flat and elongated surfaces of the waste material to the separating means in such way that elongated and flat metallic material tend to be retained by the separating means, thereby enhancing separation of the ferrous and non-ferrous metal components from the waste material by the separation means. More preferably, a variable angle vibrating conveyor/screen separator is also used in order to regulate the variable flow of the comminuted carbonaceous byproducts and associated ferrous and non-ferrous metal components across the screen/conveyor to enhance separation. The screen angle is preferably between about 10 and 45 degrees from the horizontal, and more preferably between about 13 and 20 degrees, with the exact angle being selected to maximize the retention time of the material on the screen without overloading the screen and still maintaining operating efficiency of the system. The vibrating screen/conveyor has a plurality of openings preferably between about $\frac{3}{8}$ inch and $1\frac{1}{2}$ inches, and most preferably about $\frac{3}{4}$ inch in size, through which a portion of the vibrated ash or other comminuted carbonaceous and metal incineration byproduct generally less than about $\frac{3}{8}$ inch to $1\frac{1}{2}$ inches in diameter, and preferably $\frac{3}{4}$ inch and less in diameter, passes to a collection station positioned below the vibrating screen or conveyor therefrom. The separated carbonaceous material is deposited from first separating means onto conveying means 8 and from there conveyed to collection station 9. Collection station 9 is a conventional transporting container for transporting the separated carbonaceous incineration byproducts to a landfill for disposal, or, preferably, upon comminution to appropriate size less than, for example, $\frac{3}{8}$ inch, transporting for use as balast for road beds or the like. When the latter preferred use for the carbonaceous material is desired, it may be appropriate to separately convey and collect the carbonaceous material passing through preliminary separating means 2, or to further comminute, by conventional means, the carbonaceous material passing through preliminary separating means 2 before it is deposited in collection station 9.

In a most preferred embodiment of the invention, as illustrated in FIG. 1, a second selective crushing means 14 and second separating means 15 are part of the recovery system. Second conveying means 6 conveys waste material comprised of carbonaceous incineration byproducts with associated ferrous and non-ferrous metal components from the first separating means 5 to the second crushing means 14. Second crushing means 14 is similar to the first crushing means 4 in arrangement and operation as described alternatively with reference to FIGS. 2, 3 and 4; second crushing means 5 further selectively comminutes the carbonaceous incineration byproducts to a lesser size of preferably between about $\frac{1}{4}$ and $1\frac{1}{2}$ inches and less, and most preferably $\frac{1}{2}$ inch and less, without substantially comminuting associated ferrous and nonferrous metal components of larger size. For this reason, the spacing between the roll and backing plate of crushing means 15, and the height and positioning of the protrusions of crushing means 15 are different from first crushing means 4 to provide for efficient operation. The comminuted ash and associated ferrous and non-ferrous metal components from the second crushing means 14 are conveyed by a third discharge conveying means 16 to a first magnetic means 17 for separation of the ferrous metal components from the non-ferrous metal components, such as aluminum. Third discharge conveying means 16 may also be a conventional conveyor system such as a belt conveyor.

Second separating means 15 which further separates at least part of carbonaceous incineration byproducts from associated ferrous and non-ferrous metal components, after comminution by second crushing means 14, may again be a conventional separator such as a screen separator. Most preferably, second separating means 15 is again a combination variable angle vibrating screen/-conveyor such as described above for first separting means 5. As described above with reference to first separation means 5, second separation means 15 is preferably comprised of a substantially flat preferably solid plate 18, preferably two or three feet in length and fixed to separating means 5, onto which the comminuted waste material is discharged from second selective crushing means 14. Solid plate 18 tends to orient pieces of metal in the waste material to present flat and elongated surfaces to the separating screen and thereby enhance separation of the carbonaceous components from the waste material including the ferrous and non-ferrous metal. Again, the screen angle is preferably between about 10 and 45 degrees from the horizontal, and most preferably between about 13 and 20 degrees, with the exact angle being selected to maximize the retention time of the material on the screen without overloading the screen. Similar to first separator means 5, the vibrating screen/conveyor of second separator means 15 is preferably a combination separator and conveying means having a plurality of openings, preferably between about $\frac{3}{8}$ and $1\frac{1}{2}$ inches in size, and most preferably about $\frac{3}{4}$ inch in size, which passes a further portion of the vibrated ash or other comminuted carbonaceous incineration byproduct preferably less than about $\frac{3}{4}$ to 1 inch in diameter. The separated carbonaceous material is deposited from second separator means 15 onto carbonaceous-removal conveying means 8, from which it is conveyed to collection station 9. The ferrous and nonferrous component, with an amount of tramp, is conveyed by third discharge conveying means 16 to first magnetic means 17.

The ferrous and non-ferrous metal components are separated in the system by first magnetic means 17. Magnetic means 17 may be any type of magnet which will separate the ferrous metal components, such as iron and steel, from the non-ferrous metal components, such as aluminum. In a preferred embodiment of the system, the magnet is a magnetic drum head such as manufactured by Sterns Magnetics, Inc. or Erie Magnetic, Inc. The ferrous metal components are held by the magnet and released to discharge into a ferrous collection station 12. The remaining waste material including non-ferrous metal components are discharged into a separate non-ferrous collection station 19 with the assistance of an appropriately positioned diverter 20. The salvaged ferrous and non-ferrous metal components may then be sold for the recovered ferrous and non-ferrous metal values.

The present system provides for highly efficient recovery of ferrous and non-ferrous metal components from incinerated waaste material. With a two-stage selective crushing system as illustrated in FIG. 1, typically greater than 90%, and more typically more than 95% and as high as 99%, and more, of the carbonaceous component of the waste material has been selectively comminuted to the desired screen size for separation. Typically, less than 10% and more generally less than 5% of the ferrous metal component that has been separated by use of the system is tramp, and typically less than 40% and more generally about 25% of the remaining waste material including nonferrous metal components discharged from the system are tramp.

It should also be observed that the selective crushing means 4 and 14 have other applications beside the system for recovering salvageable ferrous and non-ferrous materials from incinerated waste material as described above. For example, such selective crusher means may be useful in processing foods, such as crushing the meat of peaches or olives while leaving the pits substantially uncrushed. An embodiment of the selective crushing means may also be used in cleaning metals, e.g., in cleaning stainless steel, and in foundries for removal of the sand from castings.

Figure 6:
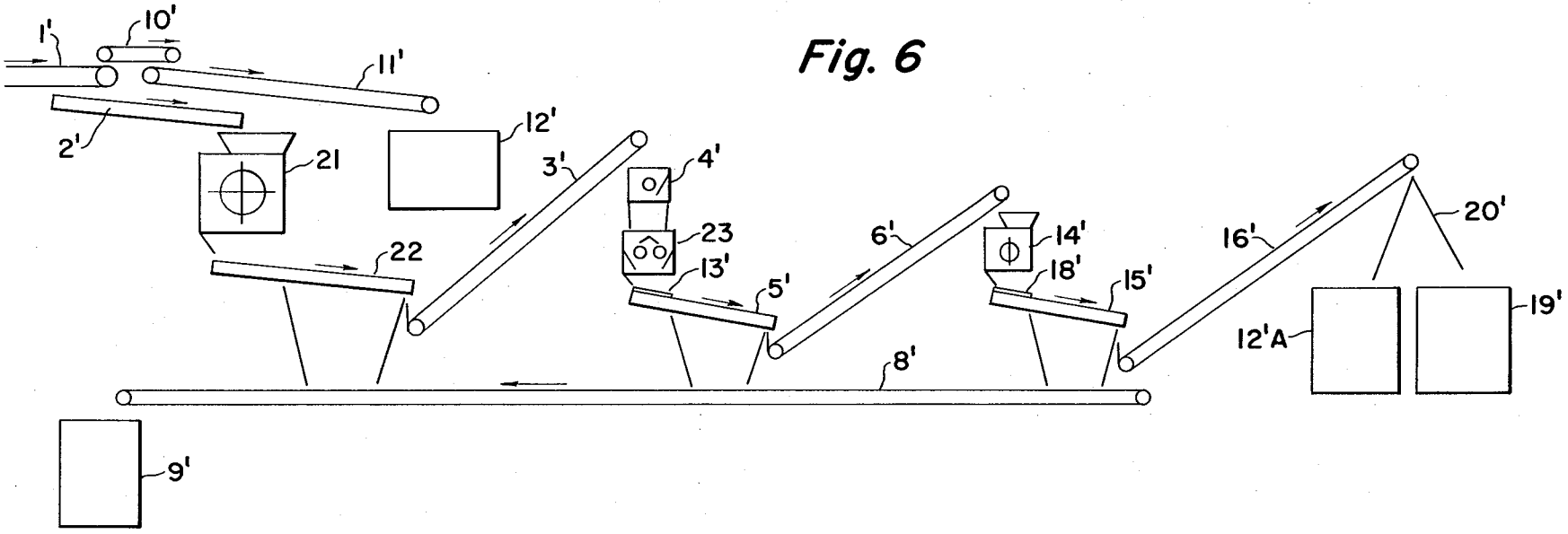
FIG. 6 is a process schematic of an alternative preferred embodiment of the recovery system of the present invention.

Still another alternative embodiment of the present system for recovery of salvageable ferrous and non-ferrous metal components from incinerated waste is illustrated by FIG. 6. The elements of the system which correspond to those described with reference to FIG. 1 have been given prime numbers corresponding to the parts and elements described with reference to FIG. 1. Selective crushing means 4' and 14' may be one of the alternative embodiments described with reference to FIGS. 2, 3, 4 and 5, but is preferably an embodiment as is described with reference to FIGS. 2 and 3. The difference in this embodiment is primarily the addition of preliminary crushing means 21 described in detail with reference to FIGS. 7 and 8, and tandem crushing means 23 described in detail with reference to FIG. 9. Additional differences are the location of the preliminary magnetic means 10' adjacent conveying means 1' from the incinerator plant, ahead of the preliminary separating means 2' rather than at the end of first conveying means 3 and just ahead of selective crushing means 4' as shown in FIG. 1. This embodiment has the advantage of removing the larger ferrous metal components from the waste material at the very outset before even preliminary separation of the carbonaceous material in the recovery system and higher efficiency in selective comminution in crushing means 23 as described in more detail below. In this embodiment, as in the embodiment described with reference to FIG. 1, larger pieces of material greater than about four to ten inches will be removed from the waste material, e.g., by a grissly or trommel, before they reach the end of conveying means 1.

Figure 7:
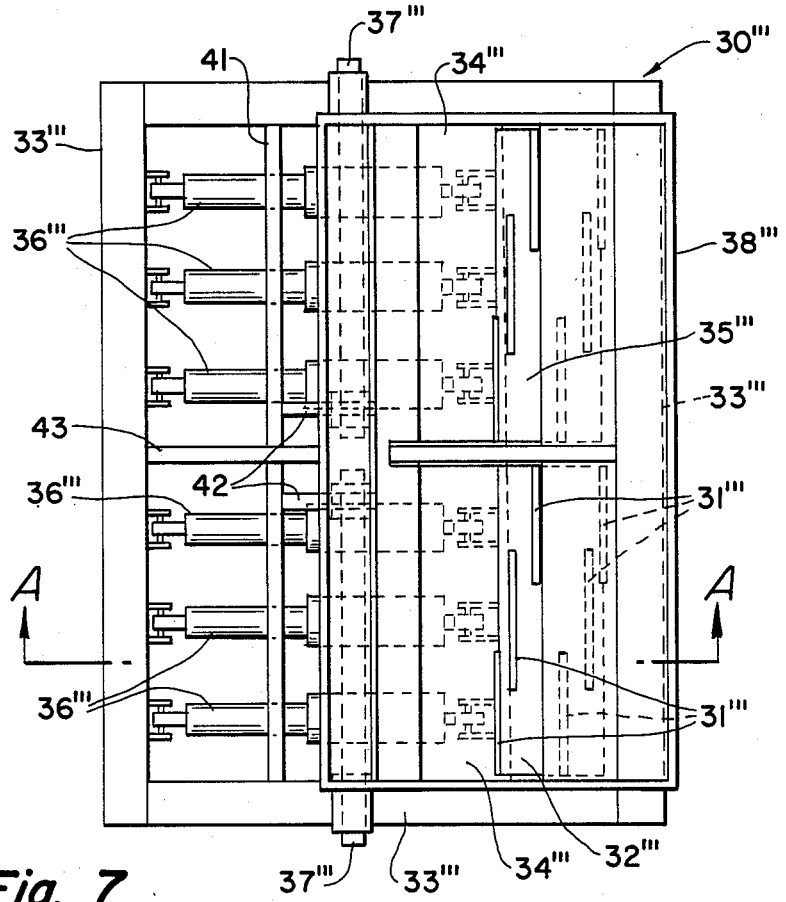
FIG. 7 is a plan view of an alternative preferred selective crusher employed in the present invention.
Figure 8:
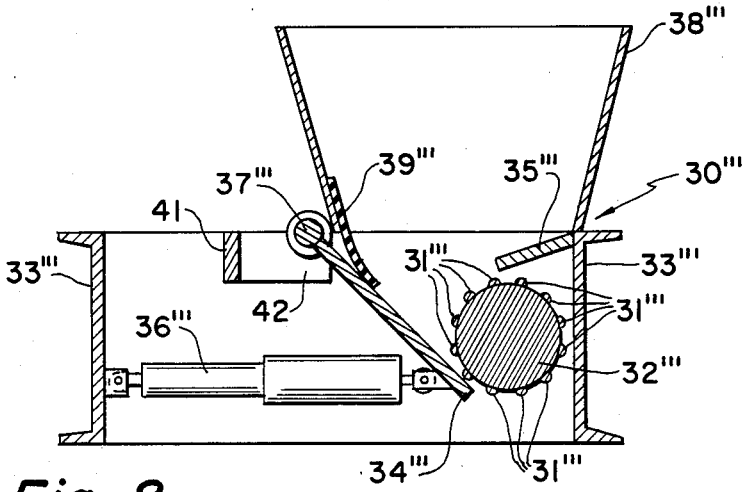
FIG. 8 is a cross-sectional view taken through line A—A of the alternative preferred selective crusher described in FIG. 7.

Referring to FIGS. 7 and 8, the selective crushing means 21 is designed for heavy duty use in selectively comminuting relatively large pieces of carbonaceous material in the incinerated waste material while avoiding, to the extent possible, comminution of the associated ferrous and non-ferrous metal components. The construction of selective crushing means 21 is preferably substantially the same as that described above with reference to FIGS. 2 and 3, except that backing plate 34''' is divided into segments so that each segment extends only about half the length of roll 32'''. Typically, roll 32''' would be four feet in length so that the segments of backing plate 34''' are preferably only two feet in length. Backing plate 34''' could similarly be provided in more than two segments if desired. In addition, to allow for independent operation of the segments of backing plate 34''', an additional brace 41 and additional supports 42 are provided as part of frame 33''' for pivotally mounting the segments of backing plate 34''' and a divider 43 extends through the selective crushing means 21. The roll 32''' is preferably larger in diameter, e.g., ten inches in diameter, than rolls 32, 32' or 32'' of selective crushing means 4 or 14, and three spaced-apart bias means 36''' are preferably provide on each segment of backing plate 34'''. Bias means 36''' are pivotally mounted to backing plate 34''' nearer the end thereof to provide better mechanical leverage for bias means 36'' to exert pressure on the waste material passing through the throat of the crushing means. In addition, selective crushing means 21 preferably has a spacing between the roll 32''' and the backing plates 34''' of about 1¼ inches (about ⅝ inch between the backing plate 34''' and protrusions 31''' on roll 32'''), and is powered by a larger horsepower electric motor, e.g., 50 pH., running at a slightly higher rpm, e.g., 660 rpm. Also preferably protrusions 31''' are elongated and staggered as shown in FIG. 7, with ends of protrusions of the staggered arrays overlapping each other. By this embodiment, backing plate 34''' can retract in segments from roll 32''' when ferrous or non-ferrous metal components pass through the throat between the roll and backing plate, and, in turn, a high volume of waste material can be efficiently selectively comminuted by crushing means 21.

Figure 9:
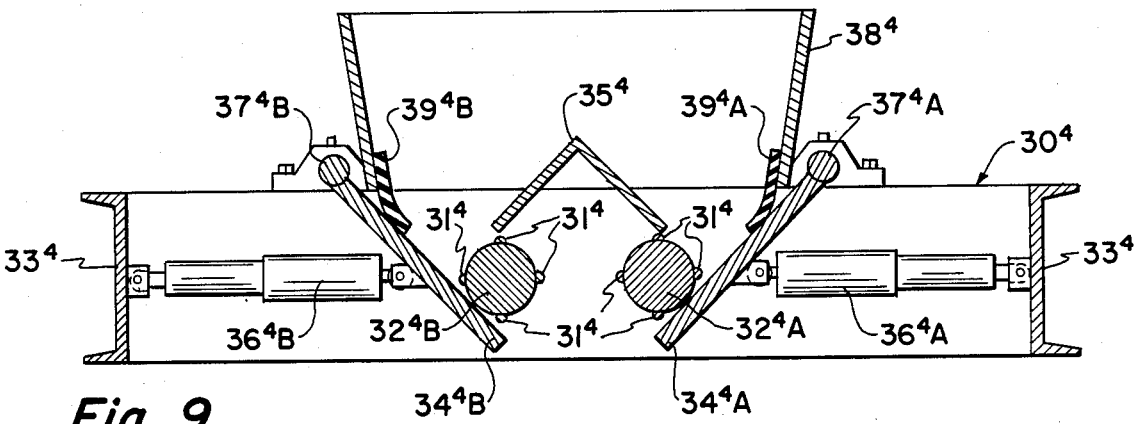
FIG. 9 is a cross-sectional view taken along line A—A of still another alternative preferred selective crusher of the present invention.

Referring to FIG. 9, selective crushing means 22 is design for a more efficient selective comminution by effectively doubling the comminution capacity of the crusher. The construction of selective crusher 23 is preferably substantially the same as that described above with reference to FIG. 2 and 3, except with two rolls 32⁴A and 32⁴B positioned in substantially parallel array. Each roll, 32⁴A and 32⁴B, has a backing plate 34⁴A and 34⁴B positioned in space relation with the roll. The backing plates are each pivotally mounted on frame 33 by bearing means 37⁴B. Backing plates 34⁴A and 34⁴B are urged toward rolls 32⁴A and 32⁴B, respectively, by bias means 36⁴A and 36⁴B, which are pivotally mounted to the opposite sides of frame 33⁴ and to backing plates 34⁴A or 34⁴B. Again, as described above with reference to FIGS. 2 and 3, the bias means 36⁴A and 36⁴B exert a pressure sufficient to comminute incinerated carbonaceous byproducts in the waste material and insufficient so as to allow the backing plates to retract and permit passage of ferrous and non-ferrous components of the waste material through the crushing means substantially uncomminuted. Again, the height and positioning of the protrusions 31⁴ on rolls 34⁴A and 34⁴B are as described above with reference to FIGS. 2 and 3. The inclined plate 35⁴ in this embodiment is V-shaped so as to direct the flow of waste material to the throat formed between each roll and the associated backing plate.

The third separating means 22 is essentially the same as that described above with reference to the first and second separating means 5 and 15. However, a flat is not preferably provided onto which the comminuted waste material is discharged from selective crushing means 21 because of the added volume of waste material at this point in the system. Typically in this embodiment, also the screen size of third separating means 22 would be selected so as to allow pieces of ½ inch or less of the waste material to pass through, and the screen sizes for first and second separating means 5' and 15' would be selected so as to allow passage of ⅜ inch pieces of waste material. In this embodiment, as shown, the carbonaceous material passed by third separating means 22 is collected on conveying means 8' from where it is conveyed to collection station 9'. However, if it is desired that the carbonaceous material collected from the system at collection station 9' be of smaller size, e.g., ⅜ inch and less, it may be preferable to collect separately waste material passing through third separating means 22 by a different conveying means and collection station. The embodiment illustrated by reference to FIG. 6 has the advantages of processing larger quantities and larger sized pieces of incinerated waste material more efficiently.

Although the invention has been described in detail in the foregoing for the purpose of illustration, it is to be understood that such detail is solely for that purpose and that variations can be made therein by those skilled in the art without departing from the spirit and scope of the invention as described by the following claims.

What is claimed is:

1. A system for recovering salvageable ferrous and non-ferrous materials from incinerated waste material including carbonaceous incineration byproducts such as ash and associated ferrous and non-ferrous metal components, comprising:

a. first conveying means for conveying incinerated waste materials to a first selective crushing means;

b. first crushing means for comminuting selectively carbonaceous incineration byproducts without substantially comminuting associated ferrous and non-ferrous metal components by passing said waste material between a rotating roll and a backing plate, said roll having at least one protrusion on exterior cylindrical surfaces thereof to enable passage of said waste material through said crushing means, and said backing plate forming a throat with said roll shaped such that the backing plate exerts concentrated pressure on waste material on passage thereof through the throat between the backing plate and the roll and said backing plate urged toward the roll by a bias means exerting a pressure sufficient to comminute carbonaceous incineration byproducts in the waste material to a desired size and insufficient so as to permit the backing plate to retract and allow passage of ferrous and non-ferrous metal components in the waste material through the crushing means substantially uncomminuted;

c. first separating means coacting with said first crushing means for at least partially separating based on size comminuted carbonaceous incineration byproducts from associated ferrous and non-ferrous metal components in the waste material;

d. first magnetic means for separating ferrous metal components from the selectively comminuted incinerated waste material; and e. collection stations for collecting separated comminuted carbonaceous incineration byproducts, separated ferrous metal components, and remaining waste material including nonferrous metal components.

2. A system for recovering salvageable ferrous and non-ferrous materials from incinerated waste material including carbonaceous incineration byproducts such as ash and associated ferrous and non-ferrous metal components as claimed in claim 1 wherein the selective comminution pressure exerted by the bias means of the first crushing means is maintained during retraction of the backing plate.

3. A system for recovering salvageable ferrous and non-ferrous materials from incinerated waste material including carbonaceous incineration byproducts such as ash and associated ferrous and non-ferrous metal components as claimed in claim 1 wherein the pressure exerted by the bias means of the first crushing means is adjustable to accommodate for variability in comminution hardness of carbonaceous material in the waste material.

4. A system for recovering salvageable ferrous and non-ferrous materials from incinerated waste material including carbonaceous incineration byproducts such as ash and associated ferrous and non-ferrous metal components as claimed in claim 1 wherein each protrusion on the roll of the first crushing means is a weld extending along the exterior surface transverse to the direction of rotation of the roll.

5. A system for recovering salvageable ferrous and non-ferrous materials from incinerated waste material including carbonaceous incineration byproducts and associated ferrous and non-ferrous metal components as claimed in claim 1 wherein the first separating means comprises a means for orienting comminuted material discharged from the first crushing means so as to present flat and elongated surfaces in the waste material to the separating means and facilitate separation of the comminuted carbonaceous byproducts from the waste material including ferrous and non-ferrous components.

6. A system for recovering salvageable ferrous and non-ferrous materials from incinerated waste material including carbonaceous incineration byproducts such as ash and associated ferrous and non-ferrous metal components as claimed in claim 1 further comprising:

f. second conveying means for conveying processed incinerated waste material from the first separating means to a second selective crushing means;

g. second crushing means for further comminuting selectively carbonaceous incineration byproducts without substantially comminuting associated ferrous and non-ferrous metal components by passing said waste material between a rotating roll and a backing plate, said roll having at least one protrusion on exterior cylindrical surfaces thereof to enable passage of the waste material through the second crushing means, and said backing plate forming a throat with said roll shaped such that the backing plate exerts concentrated pressure on waste material on passage thereof through the throat between the backing plate and the roll and said backing plate urged toward the roll by a bias means exerting a pressure sufficient to comminute carbonaceous incineration byproducts in the waste material to a desired size and insufficient so as to permit the backing plate to retract and allow passage of ferrous and non-ferrous metal components from the second crushing means substantially uncomminuted; and h. second separating means coacting with said second crushing means for at least partially separating based on size comminuted carbonaceous incineration byproducts from associated ferrous and non-ferrous metal components in the waste material.

7. The system for recovering salvageable ferrous and non-ferrous material from incinerated waste material including carbonaceous incineration byproducts such as ash and associated ferrous and non-ferrous metal components as claimed in claim 6 wherein the bias means of the first and second crushing means allows the backing plates to retract and allow passage of ferrous and non-ferrous metal components associated with carbonaceous incineration byproducts at a pressure sufficient to comminute carbonaceous incineration byproducts to particles about $1\frac{1}{2}$ inches and less in diameter.

8. The system for recovering salvageable ferrous and non-ferrous material from incinerated waste material including carbonaceous incineration byproducts such as ash and associated ferrous and non-ferrous metal components as claimed in claim 6 wherein the bias means of the first and second crushing means allows the backing plates to retract and allow passage of ferrous and non-ferrous components associated with carbonaceous incinerated byproducts at a pressure sufficient to comminute carbonaceous incineration byproducts to particles about $\frac{3}{4}$ inch and less in diameter.

9. A system for recovering salvageable ferrous and non-ferrous materials from incinerated waste material including carbonaceous incineration byproducts such as ash and associated ferrous and non-ferrous metal components as claimed in claim 6 wherein each protrusion on the roll of the first and second crushing means is a weld extending along the exterior surface transverse to the direction of rotation of the roll.

10. A system for recovering salvageable ferrous and non-ferrous materials from incinerated waste materials including carbonaceous incineration byproducts such as ash and associated ferrous and non-ferrous metal components as claimed in claim 1 further comprising:

f. a preliminary separating means prior to said first crushing means to separate noncarbonaceous materials from the incinerated waste material; and g. a preliminary magnetic means for separating ferrous metal components from the waste material prior to said first crushing means.

11. A system for recovering salvageable ferrous and non-ferrous materials from incinerated waste materials including carbonaceous incineration byproducts such as ash and associated ferrous and non-ferrous metal components as claimed in claim 1 wherein said bias means of the first crushing means allows the backing plate to retract and allow passage of ferrous and non-ferrous metal components substantially uncomminuted at a pressure sufficient to comminute carbonaceous incineration byproducts to particles about $1\frac{1}{2}$ inches and less in diameter.

12. A system for recovering salvageable ferrous and non-ferrous material from incinerated waste material including carbonaceous incineration byproducts such as ash and associated ferrous and non-ferrous metal components as claimed in claim 1 wherein said bias means of the first crushing means allows the backing plate to retract and permit passage of ferrous and non-ferrous metal components substantially uncomminuted at a pressure sufficient to comminute carbonaceous incineration byproducts to particles about $\frac{3}{4}$ inch and less in diameter.

13. A method for recovering salvageable ferrous and non-ferrous materials from incinerated waste materials including carbonaceous incineration byproducts such as ash and associated ferrous and non-ferrous metal components, comprising:

a. feeding incinerated waste materials to a selective first crushing means;

b. comminuting selectively carbonaceous incineration byproducts to a desired size in said first crushing means without substantially comminuting associated ferrous and non-ferrous metal components by passing said waste material between a rotating roll having at least one protrusion on exterior surfaces thereof facilitating passage of said waste material and a backing plate urged toward said roll at a select pressure sufficient to comminute carbonaceous incineration byproducts in the waste material to a desired size and insufficient so as to permit the backing plate to retract and allow passage of associated ferrous and non-ferrous metal components in the waste material;

c. at least partially separating based on size the comminuted carbonaceous byproducts from associated comminuted waste material including ferrous and non-ferrous metal components; and d. magnetically separating ferrous metal components from the comminuted waste material.

14. A method for recovering salvageable ferrous and non-ferrous materials from incinerated waste materials including carbonaceous incineration byproducts such as ash and associated ferrous and non-ferrous metal components as claimed in claim 13 wherein carbonaceous incineration byproducts are comminuted in said first crushing means to particles about 1½ inches and less in diameter while avoiding substantial comminution of associated ferrous and non-ferrous metal components.

15. A method for recovering salvageable ferrous and non-ferrous materials from incinerated waste materials including carbonaceous incineration byproducts such as ash and associated ferrous and non-ferrous metal components as claimed in claim 13 wherein carbonaceous incineration byproducts are comminuted in said first crushing means to particles about ¾ inch and less in diameter while avoiding substantial comminution of associated ferrous and non-ferrous metal components.

16. A method for recovering salvageable ferrous and non-ferrous materials from incinerated waste materials including carbonaceous incineration byproducts such as ash and associated ferrous and non-ferrous metal components as claimed in claim 13 wherein prior to separating as described in step c the comminuted waste material is oriented so as to present flat and elongated surfaces in the waste material to facilitate separation of carbonaceous material from the comminuted waste material including ferrous and non-ferrous metal components.

17. A selective crusher for selectively comminuting a friable material without substantially comminuting a malleable material associated with the friable material, comprising:

a. at least one roll rotatably mounted and having a generally cylindrical exterior surface;

b. a backing plate movably positioned in spaced relation to each roll and providing passage therebetween of friable material desired to be comminuted along with associated malleable material desired not to be comminuted, said backing plate forming a throat with said roll shaped such that the backing plate exerts concentrated pressure on waste material on passage thereof through the throat between the backing plate and the roll;

c. at least one protrusion on the exterior surface of each roll such as to enable passage of the friable material and associated malleable material between the roller and backing plate; and d. a bias means for urging each backing plate into spaced relation with the exterior surface of a roll at a select pressure sufficient to comminute friable material to a desired size between the roll and backing plate and insufficient so as to permit the backing plate to retract when malleable material enters between the roll and backing plate to allow passage substantially uncomminuted malleable material associated with friable material between the roll and backing plate, and for returning such backing plate rapidly to said spaced relation with the roll after the malleable material has passed between the roll and backing plate.

18. A selective crusher as claimed in claim 17 wherein selective comminution pressure is maintained by the bias means during retraction of the backing plate.

19. A selective crusher as claimed in claim 17 wherein the pressure exerted by the bias means is adjustable to accommodate for variability in comminution hardness of carbonaceous material in the waste material.

20. A selective crusher claimed in claim 17 wherein the backing plate is two or more independently operating segments so that the passage of a large piece of malleable material is permitted in one segment separately from the selective comminution is another segment.

21. A selective crusher as claimed in claim 17 wherein two rolls are positioned substantially parallel array, and a backing plate and a bias means are associated with each roll.

22. A selective crusher claimed in claim 17 wherein friable material is comminuted to particles about 1½ inches and less in diameter while avoiding substantial comminution of associated malleable materials.

23. A selective crusher claimed in claim 17 wherein friable material is comminuted to particles about ¾ inch and less in diameter while avoiding substantial comminution of associated malleable materials.

24. A selective crusher claimed in claim 17 wherein each protrusion is a weld extend along the exterior surface of the roller transverse to the direction of rotation of the roll.

25. The selective crusher described in claim 17 wherein the bias means is comprised of air pressure cylinders.

26. The selective crusher described in claim 17 wherein the bias means is comprised of hydraulic gas cylinders.

* * * * *

UNITED STATES PATENT AND TRADEMARK OFFICE

CERTIFICATE OF CORRECTION

PATENT NO. 4,815,667

DATED March 28, 1989

INVENTOR(S) Samuel Keller

It is certified that error appears in the above—identified patent and that said Letters Patent is hereby corrected as shown below:

Column 1, line 42, change "maount" to -- amount --.

Column 2, line 17, after "system" delete ",".

Column 2, lines 28-29, change "communication" to --comminution--.

Column 5, line 53, after "also" delete ",".

Column 6, line 9, change "said" to -- sand --.

Column 6, line 53, change "thereyb" to -- thereby --.

Column 10, line 17, change "more" to -- most --.

Column 11, line 63, change "waaste" to -- waste --.

Column 13, line 35, after "means" insert -- 374A or --.

Signed and Sealed this

Seventh Day of January, 1992

*Attest:*

HARRY F. MANBECK, JR.

*Attesting Officer*

*Commissioner of Patents and Trademarks*